US005665011A

United States Patent [19]

Thomas

[11] Patent Number: 5,665,011

[45] Date of Patent: Sep. 9, 1997

[54] GOLF PUTTER HEAD

[76] Inventor: Robert Thomas, 3116 Masters Dr., Clearwater, Fla. 34621

[21] Appl. No.: 755,145

[22] Filed: Nov. 22, 1996

[51] Int. Cl.[6] ..... A63B 53/04

[52] U.S. Cl. ..... 473/324; 473/349; 473/340; 273/DIG. 14

[58] Field of Search ..... 473/324, 325, 473/326, 327, 328, 329, 330, 331, 332, 333, 334, 335, 336, 337, 338, 339, 340, 341, 342, 343, 344, 345, 346, 347, 348, 349, 350, 282

[56] References Cited

U.S. PATENT DOCUMENTS

| | | | |
|---|---|---|---|
| 1,454,267 | 5/1923 | Challis | 273/DIG. 14 |
| 1,587,293 | 6/1926 | Fink . | |
| 2,121,295 | 6/1938 | Jennings | 273/DIG. 14 |
| 3,519,394 | 7/1970 | Petit-Le Du et al. . | |
| 4,768,787 | 9/1988 | Shira | 473/331 |
| 4,951,953 | 8/1990 | Kim . | |
| 5,037,102 | 8/1991 | Fuklayama et al. . | |
| 5,340,107 | 8/1994 | Baker et al. . | |
| 5,445,386 | 8/1995 | Marshall . | |
| 5,467,989 | 11/1995 | Good | 473/327 |
| 5,480,153 | 1/1996 | Igarashi | 473/349 |

*Primary Examiner*—Sebastiano Passaniti

*Attorney, Agent, or Firm*—Larson & Larson, P.A.; James E. Larson

[57] ABSTRACT

A synthetic ruby putter head is produced from a cylindrical round boule sliced into pieces. A round inside diameter diamond saw performs the cutting operation. Each resulting disc piece is temporarily cemented to a steel parallel round plate and is Blanchard ground with a rotary surface grinder having a fine diamond wheel to remove the slicing irregularities on both sides and to establish a fixed thickness for all the pieces. Thereafter, the pieces are fine ground and polished to bring out the color of the synthetic ruby and a hole is drilled into the top surface of the disc by a diamond tool and a putting shaft is inserted therein and held in place with an epoxy adhesive. The putter has a flatness on the putter face measured in light waves using a zygo interferometer that can measure flatness of 1/10 of the wavelength at 632.8 nm. The synthetic ruby putter face is polished flat to 1/4 of a wavelength or better at 632.8 nm across one inch of the putter face.

16 Claims, 6 Drawing Sheets

GOLF PUTTER HEAD

BACKGROUND OF THE INVENTION

1. Field of the Invention

This invention relates to a golf putter head. More particularly, it relates to a synthetic ruby golf putter head and a method for its manufacture.

2. Description of the Prior Art

Golf club heads are known to have been made from various materials, including composite materials characterized by aluminum or aluminum alloy combined with ceramics. Such golf club heads are described in U.S. Pat. No. 5,037,102. Other golf clubs have been made with a coating of a material having a high Young's modulus, such as a diamond coating as shown in U.S. Pat. No. 4,951,953. In addition, golf club putter heads have been made of wear resistant, highly polished aesthetically pleasing silicone nitride materials, such as shown in U.S. Pat. No. 5,340,107.

Synthetic rubies are known to be fabricated from the Verneuil method by feeding a ruby seed crystal fused with the flame of an oxyhydrogen blow pipe with a pulverulent mixture of alumina and chromium oxide and introducing the mixture to the ruby through this flame. Other methods for making synthetic ruby boules are set forth in U.S. Pat. No. 3,519,394 and the teachings of this patent are herein incorporated by reference.

It is highly desirable in golf putter heads to have a flat striking surface so that no deviation in the direction of movement of the ball is caused by the golf putter itself. Although many seemingly flat surfaces are known in the prior art, golf equipment manufacturers seek to improve this flatness characteristic of a putter head ball striking surface.

SUMMARY OF THE INVENTION

I have developed an improved putter head made from synthetic ruby having an extraordinarily flat ball striking surface. I have discovered that synthetic rubies strongly possess the ultimate properties for near perfection of flatness for a golf putter head. Synthetic ruby material is extremely hard, will sustain the highest degree of flatness, can be highly and smoothly polished, has low density and unique color and transparency characteristics. My putter has a flatness on the putter face measured in light waves using a zygo interferometer that can measure flatness of 1/10 of the wavelength at 632.8 nm. The synthetic ruby putter face is polished flat to 1/4 of a wavelength or better at 632.8 nm across one inch of the putter face.

The synthetic ruby putter head is preferably produced from a three inch diameter cylindrical round boule approximately eight inches long and sliced into pieces of approximately 1.25 inches in thickness. A round inside diameter diamond saw performs the cutting operation. Each resulting three inch diameter disc piece has a thickness of from 1.250 to 1.26 inches and is temporarily cemented to a steel parallel round plate and is Blanchard ground with a rotary surface grinder having a fine diamond wheel to remove the slicing irregularities on both sides and to establish a fixed thickness for all the pieces. Thereafter, the pieces are fine ground and polished to bring out the color of the synthetic ruby and a hole is drilled into the top surface of the disc by a diamond tool and a putting shaft is inserted therein and held in place with an epoxy adhesive.

BRIEF DESCRIPTION OF THE DRAWINGS

The invention may be best understood by those having ordinary skill in the art by reference to the following detailed description and considered in conjunction with the accompanying drawings in which.

SPECIFIC DESCRIPTION OF THE PREFERRED EMBODIMENT

Figure 1:
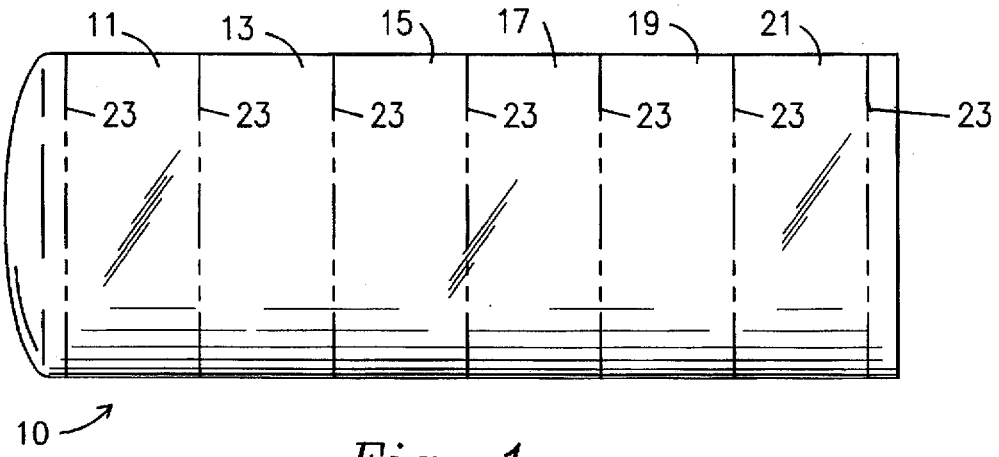
FIG. 1 shows a side view of a synthetic ruby boule with dashed lines depicting locations where the boule will be sliced.

With reference to FIG. 1, a generally cylindrical ruby boule is depicted and is generally designated by the reference numeral 10 including generally circular pieces 11, 13, 15, 17, 19 and 21, with prospective cutlines 23 being shown in phantom. As is well known to those skilled in the art and as explained hereinabove in the description of the prior art, synthetic rubies may be fabricated from various methods including the Verneuil method as explained in U.S. Pat. No. 3,519,394. The desired method is employed to create the synthetic ruby boule 10 depicted in FIG. 1. The pieces 11, 13, 15, 17, 19 and 21 are separated from one another at the cutlines 23 through use of a suitable cutting means such as, for example, a diamond saw. Thereafter, each piece 11, 13, 15, 17, 19 and 21 is subjected to the process steps explained hereinbelow with each such piece becoming a synthetic ruby golf putter head.

Figure 3:
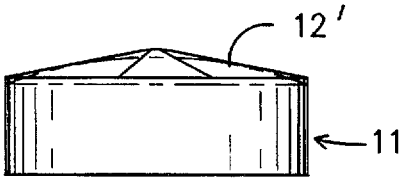
FIG. 3 shows the piece of synthetic ruby of FIG. 2 roughly ground by the cupped diamond wheel.
Figure 2:
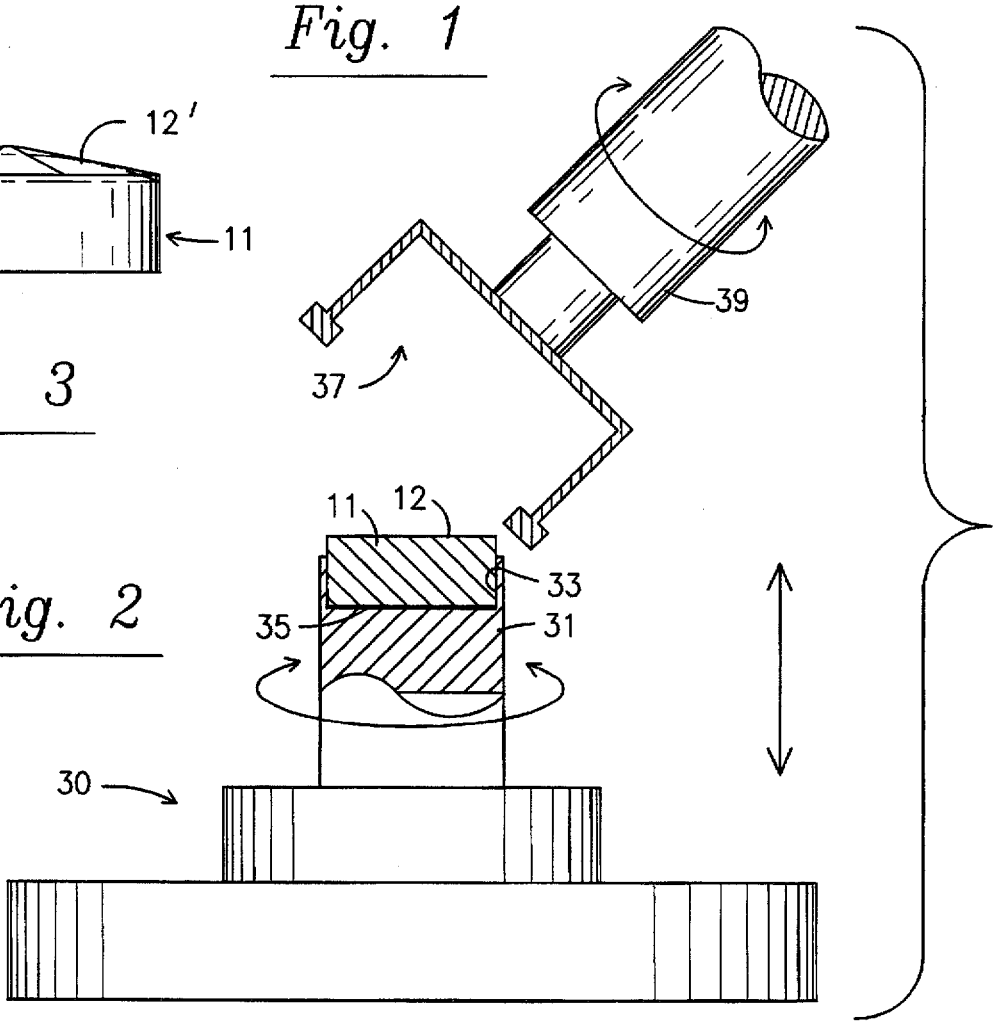
FIG. 2 shows a piece of synthetic ruby sliced from the boule of FIG. 1 and mounted on a work holder with a cupped diamond wheel about to roughly finish the exposed convex surface thereof.
Figure 5:
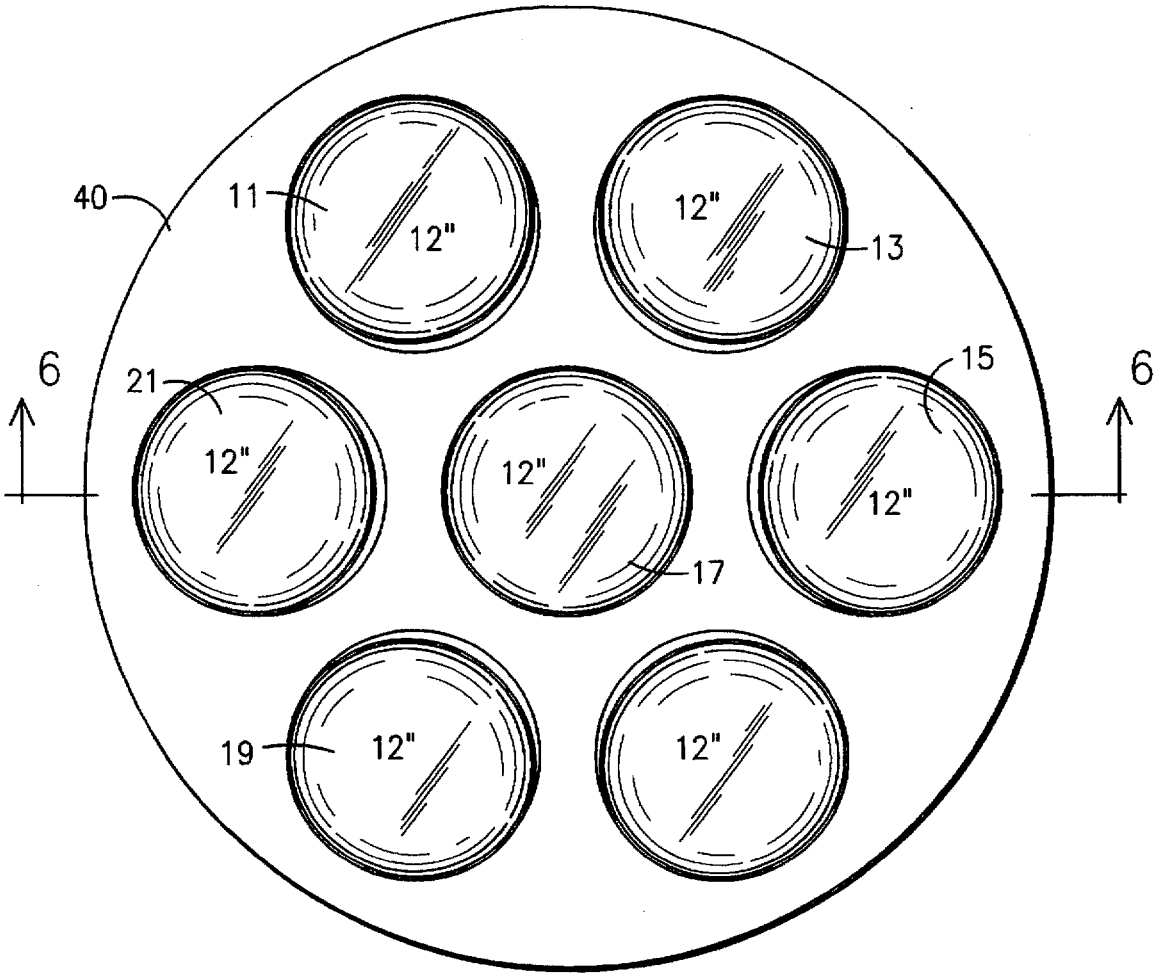
FIG. 5 shows a top view of a holder for a plurality of synthetic ruby pieces to be polished with the tool of FIG. 4.
Figure 4:
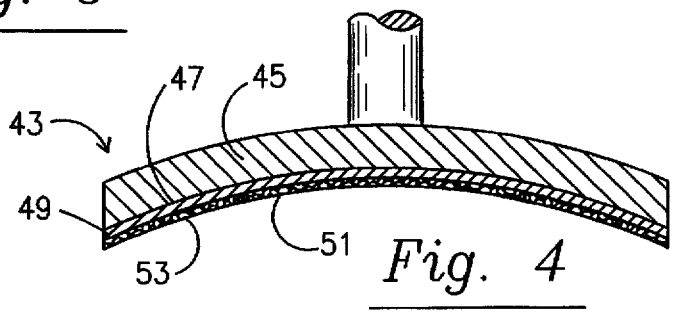
FIG. 4 shows a cross-sectional view through a polishing tool having a part spherical polishing surface.
Figure 6:
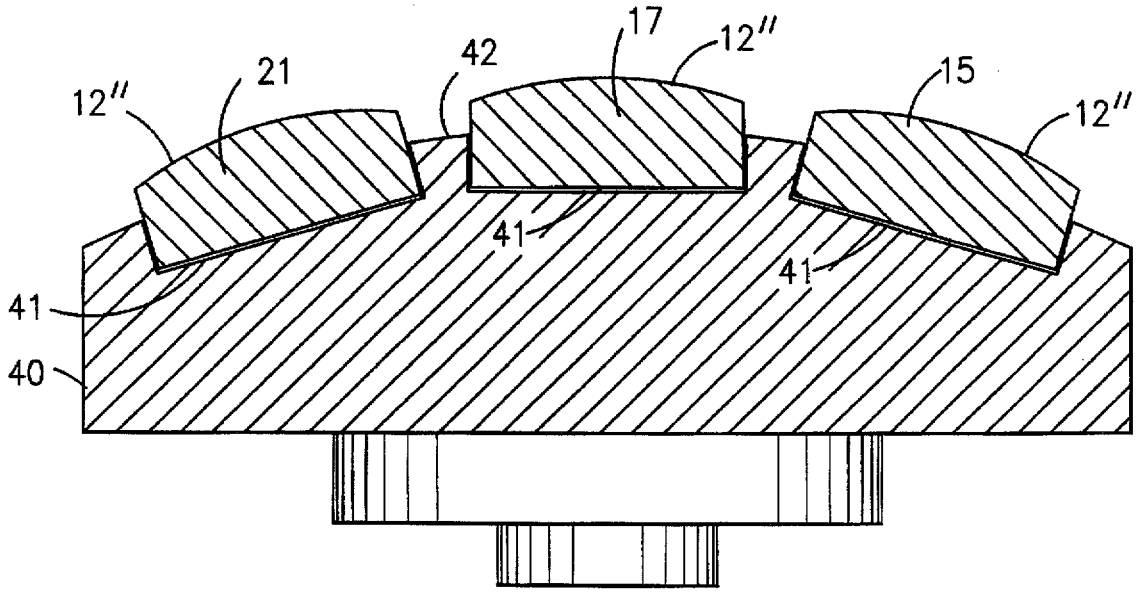
FIG. 6 shows a cross-sectional view along the line 6—6 of FIG. 5.

With reference to FIG. 2, a work holder 30 includes a portion 31 made of metal and having a recess 33 sized to receive one of the pieces 11–21, with the piece 11 being exemplary and depicted in FIG. 2. If desired, a coating of beeswax 35 may be introduced into the recess 33 to enhance retention of the piece 11 within the recess 33. Thereafter, a cupped diamond wheel 37 mounted on a rotary spindle 39 rotated by suitable means such as an electric motor is placed over the piece 11 and is employed to roughly finish the surface 12 of the piece 11. FIG. 3 shows the piece 11 with the roughly finished surface 12' corresponding to the previously unfinished surface 12. When all of the pieces 11–21 have been finished in the manner depicted in FIGS. 2 and 3, the pieces 11–21 are mounted on a holder 40 having, as best seen with reference to FIG. 6, a plurality of recesses 41, each of which is sized to receive one of the pieces with the pieces 15, 17 and 21 being depicted in FIG. 6. With the pieces so mounted in the recesses 41 of the holder 40, a polishing tool 43 is employed to polish the surfaces of the pieces 11–21 until the surfaces 12' as best depicted in FIG. 6 have been created. With reference to FIG. 4, the tool 43 consists of a steel metal backing 45 having a part spherical surface 47 to which is affixed a part spherical layer 49 of tin having a part spherical outer surface 51 to which is affixed diamond particles so that the tool 43 comprises a grinding wheel of part spherical configuration. This configuration is designed to form a part spherical surface on the surfaces 12' of FIG. 3 so that they become the part spherical surfaces 12" as best seen in FIG. 6. As shown in FIG. 6, the holder 40 has a part spherical surface 42 in which the recesses 41 are formed in the manner best seen in FIG. 6 to best facilitate operation of the tool 43.

In the preferred embodiment of the tool shown in FIG. 4, the holder 43 is made of steel and a layer of tin is epoxied to it, the advantage being that it can be machined to any spherical radius and can be impregnated with any sized diamond particles to allow for any desired degree of grinding and polishing. The tin layer should be ⅛ to ¼" thick. The holder 40 may be rotated while the tool 43 is engaged with the surfaces 12' to create the surfaces 12".

Figure 9:
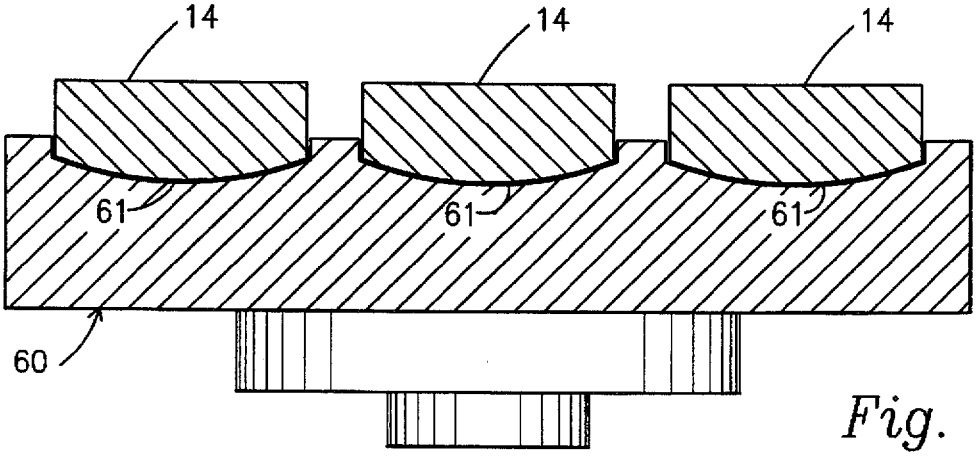
FIG. 9 shows a cross-sectional view along the line 9—9 of FIG. 8.

With reference to FIGS. 6 and 9, after the surfaces 12" have been formed with the pieces 11–21 mounted within the recesses 41 of the holder 40, the pieces 11–21 are removed from the holder 40 and are mounted in a holder 60 having recesses 61 corresponding to the surfaces 12" so that the pieces 11–21 may be inverted from the position shown in FIG. 6 and may be inserted with the surfaces 12" engaging the surfaces 61 of the holder 60 as shown in FIG. 9. If desired, a material such as, for example, beeswax may be employed to aid in the retention of the pieces within the recesses 41 of the holder 40 or the surfaces 61 of the holder 60, as the case may be.

Figure 7:
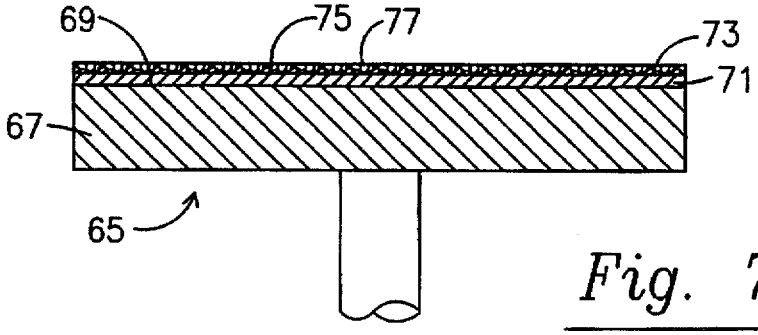
FIG. 7 shows a polishing tool having a flat polishing surface.

With reference to FIG. 7, the polishing tool 65 includes a metal backing 67 having a flat surface 69 to which a flat tin layer 71 about ⅛ to ¼ inch thick is epoxied. The tin layer 71 has an outer surface 73 on which a layer 75 of diamond particles embedded therein is disposed. The layer 75 has a generally flat outer surface 77 that is used to polish the surfaces 14 of the pieces 11–21 to an extremely flat configuration. In accordance with the teachings of the present invention, the flatness of the surfaces 14 may be measured in light waves using a zygo interferometer that can measure flatness of 1/10 of the wavelength of light at 632.8 nm. The surfaces 14 are polished using the polishing tool 65 to a flatness of ¼ of the wavelength defined by 632.8 nm. The holder 60 may be rotated while the tool 65 is engaged with the surfaces 14.

Figure 10:
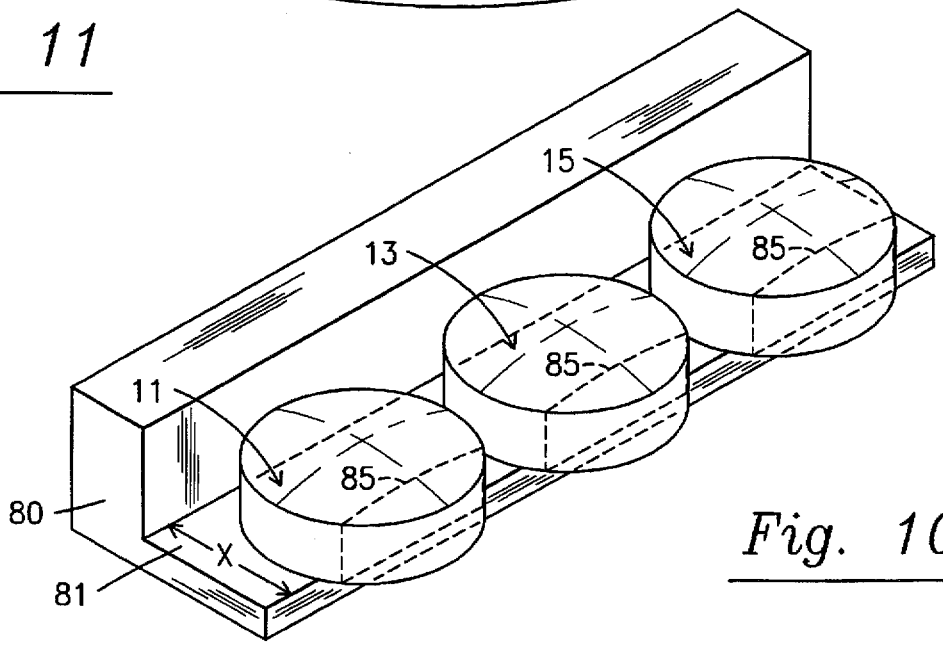
FIG. 10 shows a plurality of polished synthetic ruby pieces with dotted lines on the front portion of pieces depicting locations where a piece will be resected.

Thereafter, with reference to FIG. 10, the pieces 11–21 of which the pieces 11, 13 and 15 are shown in FIG. 10 are placed on a work holder 80 having a surface 81 defining a distance X permitting determination of a cutting plane shown in FIG. 10 with the dashed lines 85. A suitable saw such as a diamond saw is used to cut the pieces at the dashed lines 85 to create the flat surfaces 16 seen in FIG. 11.

Figure 8:
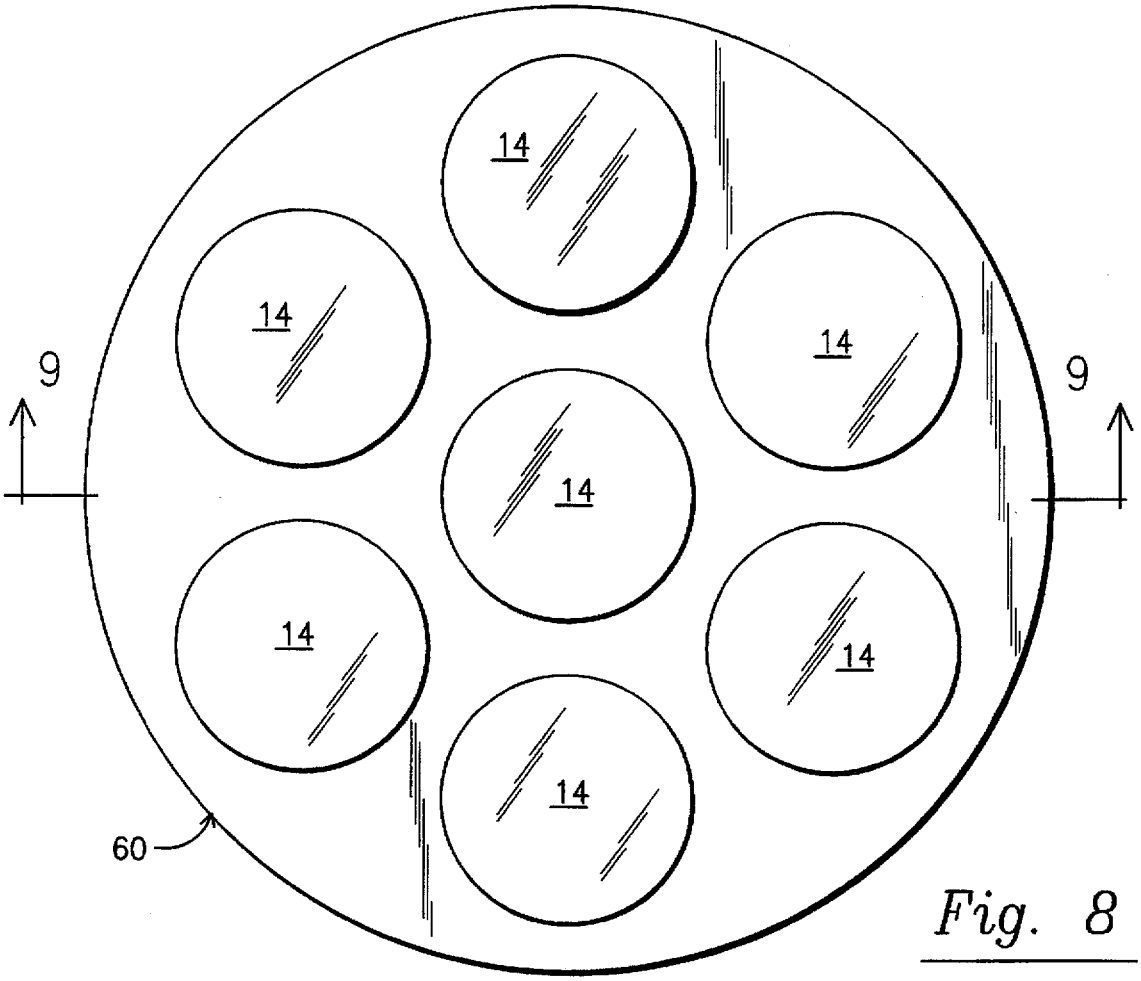
FIG. 8 shows a top view of a plurality of synthetic rubies mounted in a holder and polished with the tool of FIG. 7.
Figure 11:
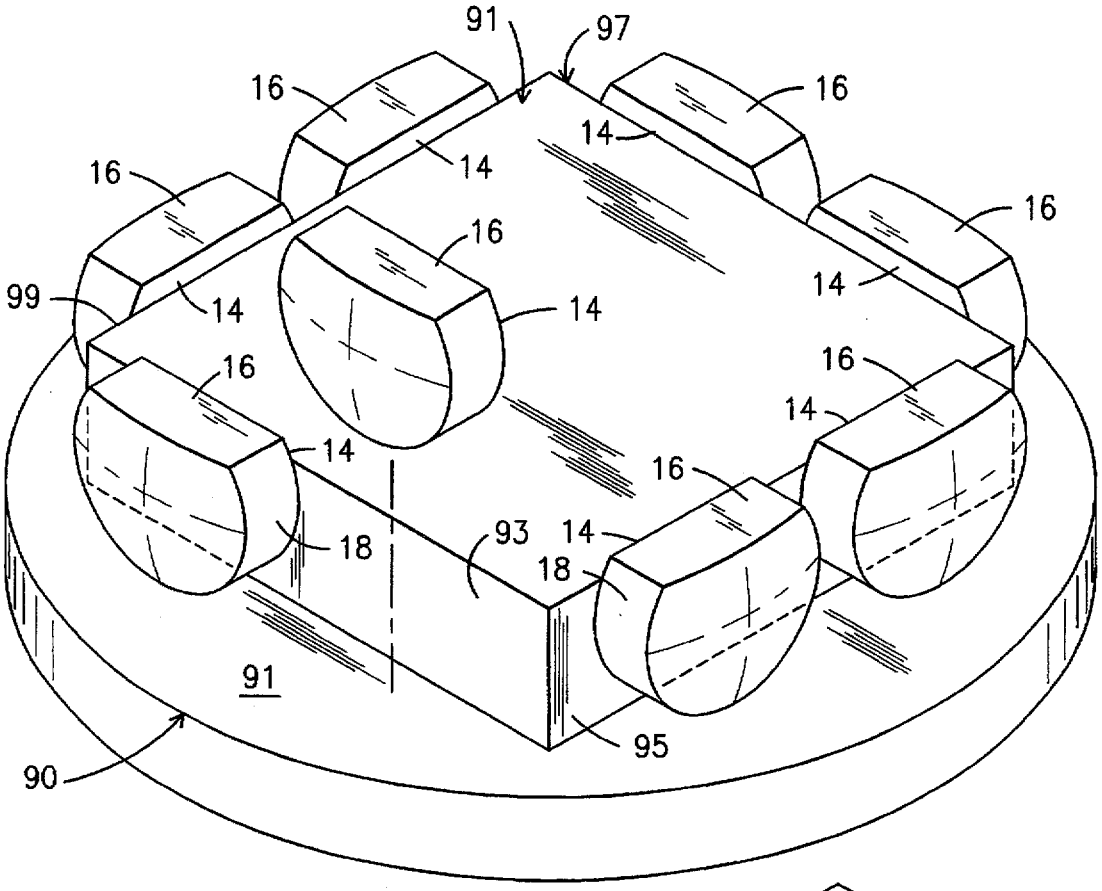
FIG. 11 shows a plurality of synthetic ruby pieces with pieces resected therefrom, ready for final polishing.
Figure 12:
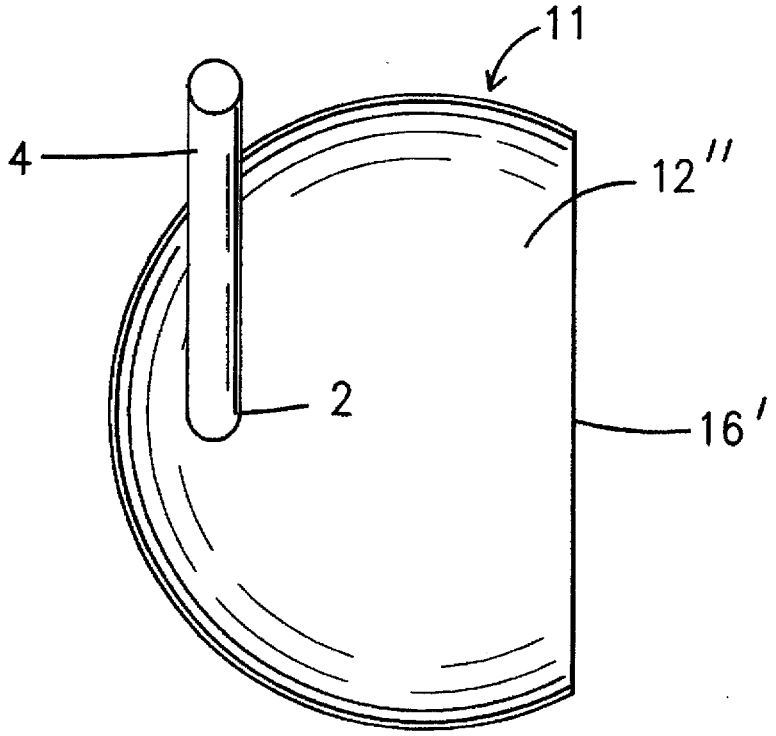
FIG. 12 shows a top view of a synthetic ruby golf putter including a shaft mounted to the synthetic ruby head.
Figure 13:
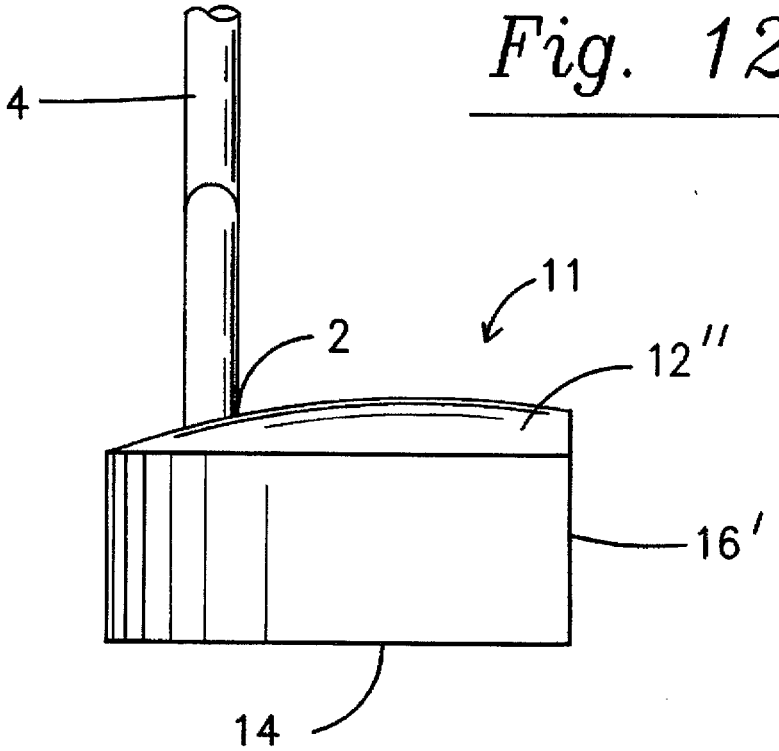
FIG. 13 shows a side view of the putter of FIG. 12.

FIG. 11 shows a further work holder 90 having a flat surface 91 on which a side wall 18 of each piece 11–21 sits, with the work holder 90 also including vertically extending walls 93, 95, 97 and 99 on which the flat surfaces 14 may be affixed through any suitable means such as, for example, beeswax. Thereafter, the polishing tool illustrated in FIG. 7 is employed to transform the surface 16 on each piece 11–21 as shown in FIG. 11 into the polished flat surfaces 16' as seen in FIGS. 12 and 13. The flatness of the surfaces 16' corresponds to the flatness of the surfaces 14 described hereinabove with reference to FIGS. 8 and 9. Each surface 16' comprises a chord in the context of the generally circular periphery of each piece.

With reference to FIGS. 12 and 13, once all the fabrication steps explained hereinabove have been completed, a hole 2 is drilled into the finished piece, for example, 11 in FIGS. 12 and 13, and a shaft 4 is inserted into the hole 2 and retained therein by suitable means such as an epoxy-based adhesive. The result is a putter having a face 16' that is extremely flat with the head being extremely lightweight (3.98 g/cc) and having an attractive reddish color of transparent consistency. The shaft 4 preferably extends along an axis generally perpendicular to the surface 14.

The low density is ideal to provide a touch or feel attractive to golfers. Such low density permits adjustments in weight distribution for different designs of the putter head.

In the preferred embodiment of the present invention, the shaft 4 and, thus, the hole 2 have a diameter of about 8 mm.

Accordingly, an invention has been disclosed in terms of a preferred embodiment thereof that fulfills each and every one of the objects of the present invention as set forth hereinabove and provides a new and useful synthetic ruby golf putter head and method of manufacture of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

Having thus described the invention, what is claimed and desired to be secured by Letters Patents is:

1. A golf club putter head formed entirely of a piece of monolithic synthetic ruby having a hitting surface with a uniform polished appearance and the hitting surface having a degree of flatness measured in light waves, using a zygo interferometer, of less than ¼ wavelength at 632.8 nm across one inch of the hitting surface.

2. The head of claim 1, wherein said piece is generally circular, said hitting surface comprising a chord of said generally circular piece.

3. The head of claim 1, said piece having a flat bottom surface.

4. The head of claim 1, said piece having a convex upper surface.

5. The head of claim 4, said piece having a flat bottom surface.

6. The head of claim 4, further including a blind bore formed in said upper surface.

7. The head of claim 6, further including a shaft having an end mounted in said blind bore.

8. The head of claim 7, said shaft extending along an axis generally perpendicular to said bottom surface.

9. A method of manufacturing a golf putter head including the steps of:

a) providing a synthetic ruby boule;

b) cutting a piece from said boule;

c) slicing away a portion of said piece to leave a generally flat surface on said piece; and d) polishing said surface to an extremely flat configuration having a degree of flatness measured in light waves, using a zygo interferometer, of less than ¼ wavelength at 632.8 nm across one inch of said surface.

10. The method of claim 9, wherein said piece is generally cylindrical.

11. The method of claim 9, wherein said generally flat surface comprises a side surface, said piece having an upper surface and a bottom surface.

12. The method of claim 11, said polishing step comprising polishing with a flat tin diamond polishing tool.

13. The method of claim 11, further including the step of polishing said bottom surface into a flat configuration.

14. The method of claim 13, further including the step of polishing said upper surface into a convex configuration.

15. The method of claim 14, further including the step of drilling a blind bore into said upper surface.

16. The method of claim 15, further including the step of mounting a shaft in said blind bore.

* * * * *